United States Patent [19]

Thimon

[11] Patent Number: 5,040,358

[45] Date of Patent: Aug. 20, 1991

[54] METHOD AND MACHINE FOR HELICALLY DEPOSITING A BAND OF FILM ON THE VERTICAL FACES OF A PALLETIZED LOAD

[75] Inventor: Jacques Thimon, St. Louis, Mo.

[73] Assignee: Newtec International (Societe Anonyme), Aix-Les-Bains, France

[21] Appl. No.: 560,182

[22] Filed: Jul. 31, 1990

[30] Foreign Application Priority Data

Aug. 2, 1989 [FR] France ..... 89 10436

[51] Int. Cl.[5] ..... B65B 11/04

[52] U.S. Cl. ..... 53/556; 53/587; 53/389.1

[58] Field of Search ..... 53/556, 587, 588, 389, 53/441

[56] References Cited

U.S. PATENT DOCUMENTS

| | | | |
|---|---|---|---|
| 2,716,315 | 8/1955 | Jacoby | 53/587 |
| 4,050,221 | 9/1977 | Lancaster, III et al. | 53/211 |
| 4,235,062 | 11/1980 | Lancaster | 53/587 X |
| 4,255,918 | 3/1981 | Lancaster et al. | 53/556 |
| 4,271,657 | 6/1981 | Lancaster, III et al. | 53/399 |
| 4,302,920 | 6/1984 | Lancaster et al. | 53/399 |
| 4,336,679 | 6/1982 | Lancaster et al. | 53/399 |
| 4,387,548 | 6/1983 | Lancaster et al. | 53/399 |
| 4,387,552 | 6/1983 | Lancaster et al. | 53/556 |
| 4,418,510 | 12/1983 | Lancaster, III et al. | 53/399 |
| 4,590,746 | 5/1986 | Humphrey | 53/556 |
| 4,757,952 | 7/1988 | Balzer | 53/587 X |

FOREIGN PATENT DOCUMENTS

| | | | |
|---|---|---|---|
| 0180517 | 5/1986 | European Pat. Off. . | |
| 0110751 | 1/1988 | European Pat. Off. . | |
| 2948662 | 6/1981 | Fed. Rep. of Germany | 53/556 |
| 2281275 | 3/1976 | France . | |
| 2417167 | 8/1980 | France . | |
| 2468506 | 5/1981 | France . | |
| 2489780 | 3/1982 | France . | |
| 2535297 | 1/1985 | France . | |
| 2470056 | 5/1986 | France . | |
| 2571656 | 11/1986 | France . | |
| 2571655 | 2/1987 | France . | |
| 2572359 | 9/1987 | France . | |
| 2059906 | 4/1981 | United Kingdom . | |
| 2083002 | 3/1982 | United Kingdom | 53/556 |

OTHER PUBLICATIONS

Copy of French Search Report cited in Prosecution of the Priority Application.

*Primary Examiner*—John Sipos

*Attorney, Agent, or Firm*—Body, Vickers & Daniels

[57] ABSTRACT

In a vertical and helical banding machine having a rotary table, a carriage mounted on a mast secured to a stand is driven between upper and lower positions and has a delivery roller rotatable about a vertically stationary axis for passing the banding film to helically wrap or band the load. The carriage includes a support for changing the direction of banding film from a horizontal to a veritcal position as the film is delivered to the delivery roll. A prestretching mechanism is provided for prestretching the film prior to delivery to the carriage. The mechanism includes a horizontal vertically movable bearing roller carrying the film reel and a horizontal support roller parallel to the bearing roller and positioned beneath the film reel and supporting same whereby the lower horizontal generatrix between the reel of film and the support roller forms a constant reference to control the speed of film being unwound from the reel and in conjunction therewith acts as a prestretching mechanism.

12 Claims, 5 Drawing Sheets

11
11a
27,22
25
31
31a
36a
12,28,36
17
14
16
1

V1
V2
29
30,22
12,36

METHOD AND MACHINE FOR HELICALLY DEPOSITING A BAND OF FILM ON THE VERTICAL FACES OF A PALLETIZED LOAD

The invention relates to a method and a machine for helically depositing a band of film on the vertical faces of a palletized load.

A method is already known for helically depositing a band of film on the vertical faces of a palletized load in which the load is conveyed onto a table; the film originating from a reel of film is passed over a roller controlling the delivery rate of the film and a delivery roller with a vertical axis; the first free end part of the film is then connected to the load; the table, and hence the load, is then driven in rotation about a vertical axis; and the delivery roller is driven vertically up and down between two extreme positions, an upper one and a lower one, as a function of the rotation of the table so as to band helically the load with the film; then, once the banding operation is finished, the film is cut transversely in the vicinity of the load and the last free end part of the film is connected to the load or to the band of film.

Such a method makes use of a known machine of the type comprising a fixed stand; a table for receiving the load, carried by the stand and mounted so as to pivot about its vertical axis so as to be able to be, selectively, locked in rotation or driven in rotation by way of drive and locking means and control means; a fixed vertical mast carried by the stand and forming a support; bearings supporting a reel of film and carried by the stand; a control roller; a carriage mounted so as to slide up and down, in the vertical direction, on the mast between two extreme positions, an upper one and a lower one, and driven in a sliding motion by drive means associated with control means which are associated with the means for controlling the table; a delivery roller having a vertical axis and carried by the carriage.

The state of the art is illustrated by certain machines of the series known under the name "DRA-PAL" marketed by the companies of the NEWTEC INTERNATIONAL Group. They are known as vertical-and-helical banding machines having a rotating table, as opposed to packaging machines such as those with a fixed table and a reel of film with a pivoting axis, or those in which the load is displaced horizontally, the reel of film rotating about it in a vertical plane, or those in which the load is displaced horizontally, facing a screen of film held taut between two reels of film with vertical axes.

The above-described method and machine may form the subject of alternative embodiments.

This technology is preferably employed with a stretchable film which is stretched beyond the elastic limit so as to create, subsequently, once applied to the load, compressive forces and forces maintaining the cohesion of the load.

In this case, a pre-stretching device is used having two rollers, an upstream one and a downstream one, or having a single roller, as emerges from the documents FR-A-2,281,275, FR-A-2,468,506, FR-A-2,470,056 FR-A-2,489,780, FR-A-2,571,655, FR-A-2,571,656.

The machine may also have a pressure disk; a pinching tool for gripping the film and, associated with it, means for transversely cutting the film and for connecting the film to itself or to the load (see in particular documents U.S. Pat. Nos. 4,255,918, 4,271,657, 4,336,679, 4,387,548, 4,387,552, 4,418,510, 4,050,221, 302,920, FR-A-2,417,167, EP-A-0,110,751, FR-A-2,535,297, FR-A-2,572,359).

A shared feature of all these machines is that the reel of film and, if appropriate, the pre-stretching device have vertical axes and are carried by the vertically movable carriage.

Various problems arise: the need for a strong carriage in order to support at the same time a reel of film, the corresponding bearings and the pre-stretching device; the difficulty in positioning the reel of film which must be engaged on bearings with vertical axes in a zone (the carriage) which is poorly accessible; the difficulty in positioning the film in the pre-stretching device for the same reason; a mast which is also strengthened in order to support the carriage; electrical connections with the pre-stretching device which are flexible in order to adapt to the mobility of this device, etc.

A helical-banding machine is described in the document U.S. Pat. No. 4,590,746 which, in a second alternative embodiment, has an upper reel of film with a horizontal axis. The film originating from the reel of film passes into a pre-stretching device, then onto a return roller at a distance from the pre-stretching device, then onto a rod inclined at 45°, and then onto a jockey roller with a movable axis and carried by jockey arms. This locating of the jockey roller downstream from the inclined rod does not, however, permit optimum functioning. Secondly, the locating of the reel of film in the upper part is awkward. Lastly, the use of a return roller in the structure in question increases the length of film between the pre-stretching device and the load, which is not very favorable. As a consequence, the arrangement according to the document U.S. Pat. No. 4,590,746 cannot be satisfactory.

The object of the invention is to overcome this problem. To this end, it proposes firstly a method of the type defined above in which, during the banding operation, the reel of film and the control roller are held in a fixed location with their horizontal axes parallel; the film is acted upon in order to, in succession and in this order, starting from the reel of film, pass it over the control roller, change its direction, continuously, in order to switch its transverse direction T from the horizontal state when it leaves the roller to the vertical state when it enters the roller, and to pass it over the roller.

The invention secondly proposes a machine of the type defined above in which the support bearings and the control roller have horizontal and parallel axes and are situated in a fixed location on the mast, independent of the carriage; the carriage also supports means for changing the direction of the film, continuously, between where it leaves the control roller and where it enters the delivery roller.

The other features of the invention will emerge from the description which follows, made with reference to the attached drawings, in which.

Figure 1:
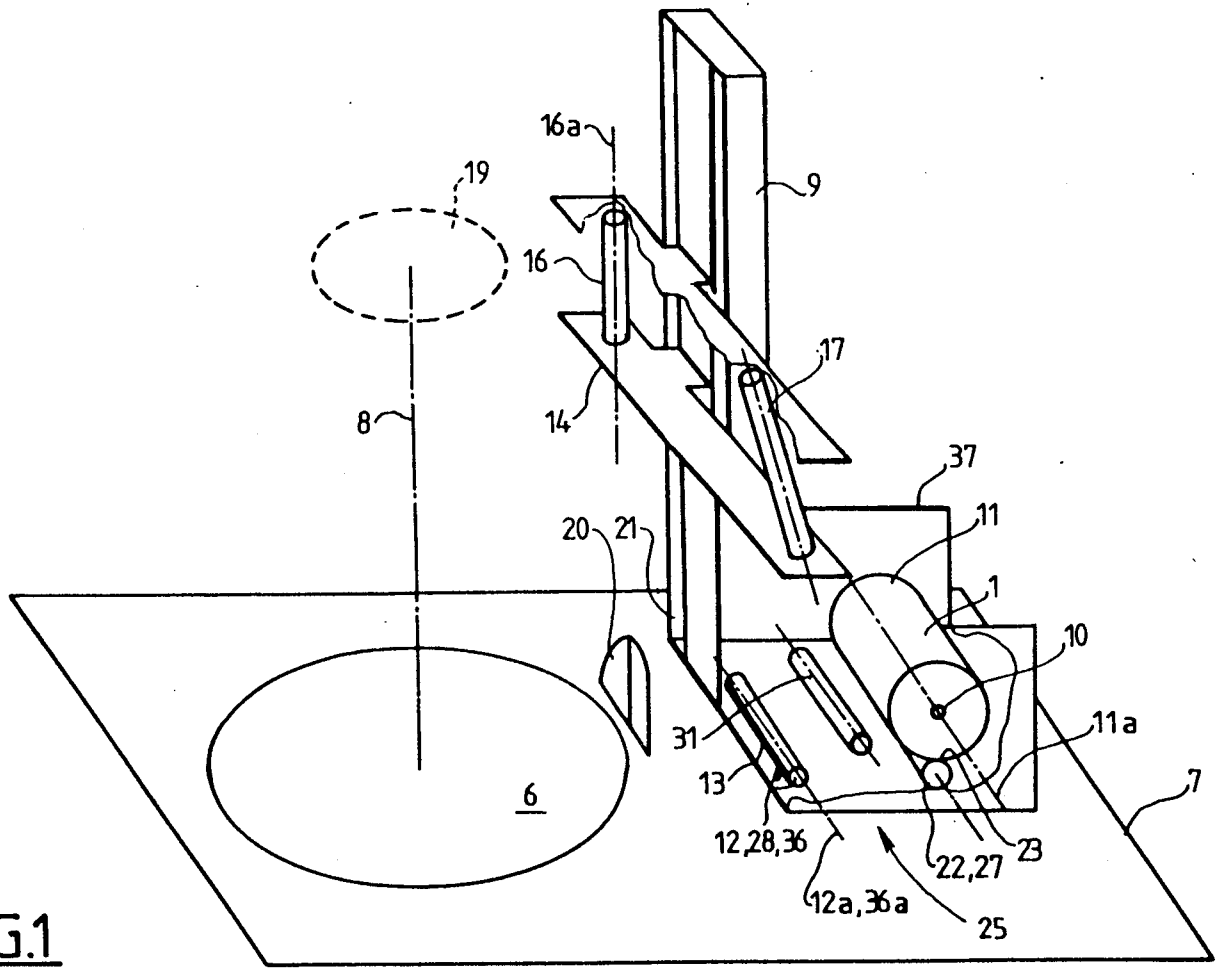
FIG. 1 is a diagrammatic view in perspective of a machine according to the invention.

The invention relates to a method and a machine for helically depositing a band of film 1 on the vertical faces 2 of a load 3 such as a palletized load which also has a lower horizontal face 4 and an upper horizontal face 5. The machine is a machine for packaging a palletized load of the type having a rotating table 6. It comprises: a fixed stand 7; a table 6 for receiving the load 3, carried by the stand 7 and mounted pivotably about its vertical axis 8 so as to be able to be, selectively, locked in rotation or driven in rotation by way of drive and locking means and control means; a vertical fixed mast 9 carried by the stand 7 and forming a support; bearings 10 supporting a reel 11 of film and carried by the stand 7; a control roller 12 having an exit generatrix 13 situated in the vicinity of the bearings 10 supporting the reel 11 of film, and carried by the stand 7; a carriage 14 mounted so as to slide up and down in the vertical direction on the mast 9 between two extreme positions, an upper one and a lower one, and driven in a sliding motion by drive means 15 associated with control means which are themselves associated with the means for controlling the table 6; and a delivery roller 16, having a vertical axis 16*a*, carried by the carriage 14.

The stand 7 chiefly comprises a horizontal base plate resting on the ground and on which the mast 9, offset, is fixed. The table 6 is driven by way of a geared motor controlled from an electric control box including a programmed robot. The mast 9 is arranged in order to serve as a vertically sliding guide for the carriage 14, it being possible for the drive means to include an endless chain. The control roller 12 also constitutes a return roller The machine makes use of a method in which the load 3 is conveyed onto the table 6; the film 1 is passed over the roller 12 and over the delivery roller 16; the first free end part of the film 1 is then connected to the load 3; the table 6, and hence the load 3, is then driven in rotation about its vertical axis 8; the delivery roller 16 is driven vertically up and down between two extreme positions, an upper one and a lower one, as a function of the rotation of the table 6 so as to helically band the load 3 with the film 1; then, once the banding operation is finished, the film 1 is cut transversely in the vicinity of the load 3 and the last free end part of the film 1 is connected to the load 3 or to the band of film 1.

The support bearings 10 and the control roller 12 have horizontal and parallel axes 11*a*, 12*a* and are situated in a fixed location on the mast 9, independent of the carriage 14. The carriage 14 supports, in addition to the delivery roller 16, means 17 for changing the direction of the film 1, continuously, between the generatrix 13 where it leaves the roller 12 and where it enters the delivery roller 16. During the banding operation, the reel of film 11 and the control roller 12 are held in a fixed location Before passing the film 1 over the delivery roller 16, its direction is changed, continuously, in order to switch its transverse direction T from the horizontal state when it leaves the control roller 12 to the vertical state when it enters the delivery roller 16. Transverse direction T of the film is understood to mean that corresponding to its breadth, in other words that perpendicular to its length corresponding to the unwinding direction.

The machine may also comprise, carried by the mast 9 by way of a bracket 18, a pressure disk 19 mounted so as to be able to be raised or lowered by way of drive means, and able to pivot freely about its vertical axis 8, driven in a pivoting motion by the load when it is applied to its upper horizontal face 5. The machine may also comprise a pinching tool 20 for gripping the film 1 which may be opened and closed, and retracted as a unit, by way of drive means, is carried by the base plate or the table 6, or by the carriage 14, or by the pressure disk 19, and with which means for transversely cutting the film 1 and/or means for connecting the film 1 to itself or to the load 3 may be combined.

Figure 3:
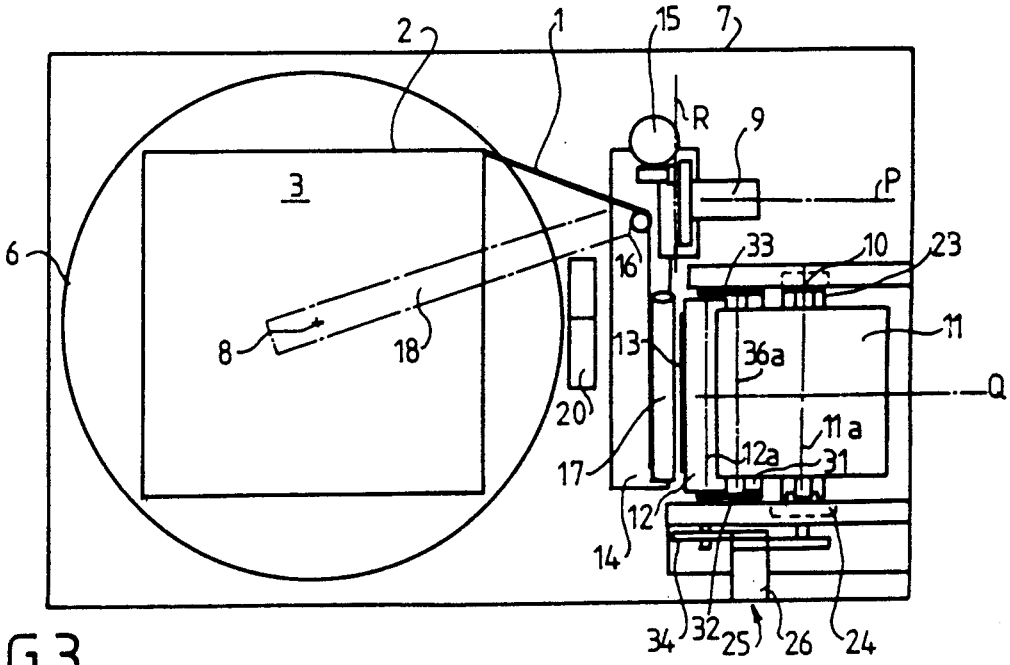

The mast 9 is off-centered in order to enable the reel of film 11 to be located. As a consequence (FIG. 3), the bracket 18 is not orthogonal (in the horizontal plane) to the mast 9, as in the prior art, but inclined in order to compensate for the transverse horizontal offset between the plane P of the mast 9 and the parallel plane Q of the reel of film 11. Similarly, the pinching tool 20 may be offset, either with respect to the mast 9 or with respect to the reel of film 11, or with respect to both of them.

The support bearings 10 and the control roller 12 are located at the lower end part 21 of the mast 9, and more particularly at the foot of the mast 9, just next to and adjoining it in the front direction with respect to the table 6. This structural arrangement enables the reel of film 11 to rest on the base plate of the stand 7 whilst at the same time having the advantage of retention by the mast 9.

The control roller 12 is situated near the bearings 10 and at a level situated beneath the bearings 10. The control roller 12 is placed in the vicinity of the front plane R of the mast 9, and the reel 11 is placed to the rear of the latter, in other words opposite the distance apart at which the table 6 stands.

A horizontal roller 22 supporting the reel of film 11 and placed vertically beneath the bearings 10 may be provided, serving as a support for the reel of film 11 by way of its lower horizontal generatrix 23. In this case, the support bearings 10 are mounted so as to slide freely in the vertical direction by way of guide means 24. This structural arrangement enables the exit generatrix 23 of the reel of film 11 to form a constant "reference", which is not possible with a reel of film having a vertical axis. This also enables the film to be conveyed at a controlled speed, by acting on the support roller 22.

The film 1 may be stretchable. The package obtained by the film 1 may cover all the faces 2 or only some of them. The package may be single-layered or multi-layered, regular or irregular. According to a preferred embodiment of the invention, which is not limiting, a stretchable film is employed which is stretched before being applied to the load 3 beyond its elastic limit. The machine then comprises means capable of performing this stretching, and the method a step consisting in stretching the film longitudinally. The stretching may be performed in various different ways, in particular and preferably by the method known in the state of the art under the name of "pre-stretching" (French Patent 2,281,275). In this case, the film 1, located on the control roller 12, changes from a lower upstream unwinding speed V1 to a downstream unwinding speed V2 greater than V1. The pre-stretched film 1 is then transported onto the load 3 via the delivery roller 16. A certain over-stretching of the film 1 may also be performed after its pre-stretching.

Figure 2:
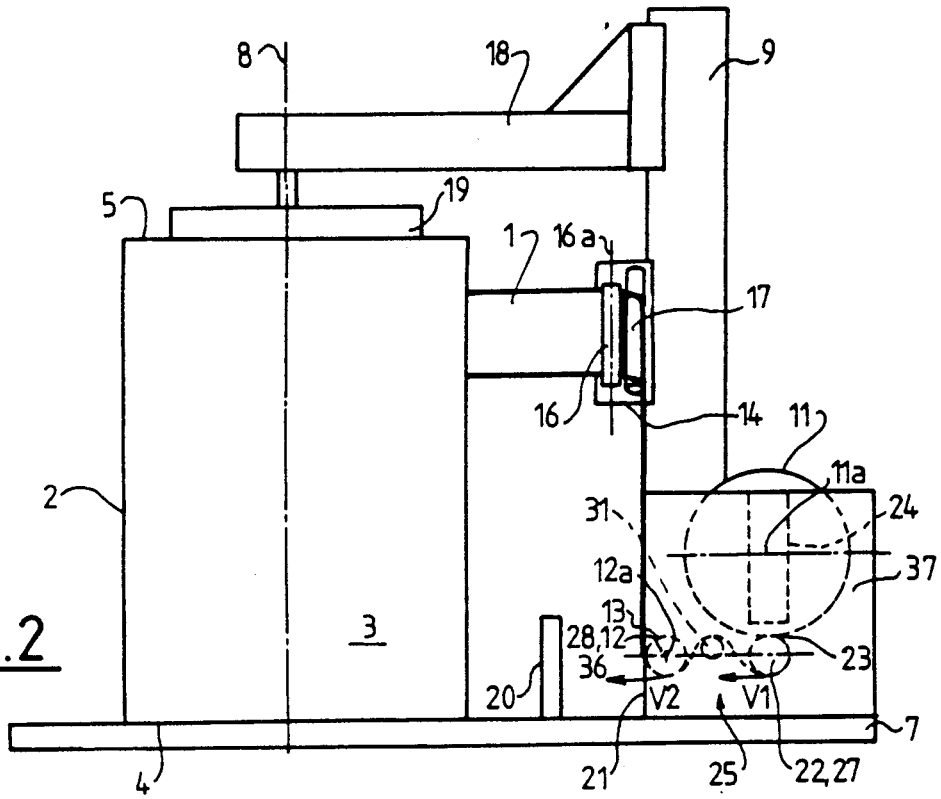
FIGS. 2, 3, 4 are three diagrammatic views of the machine in FIG. 1, in elevation, from above (pressure means removed), and from the rear, respectively.
Figure 4:
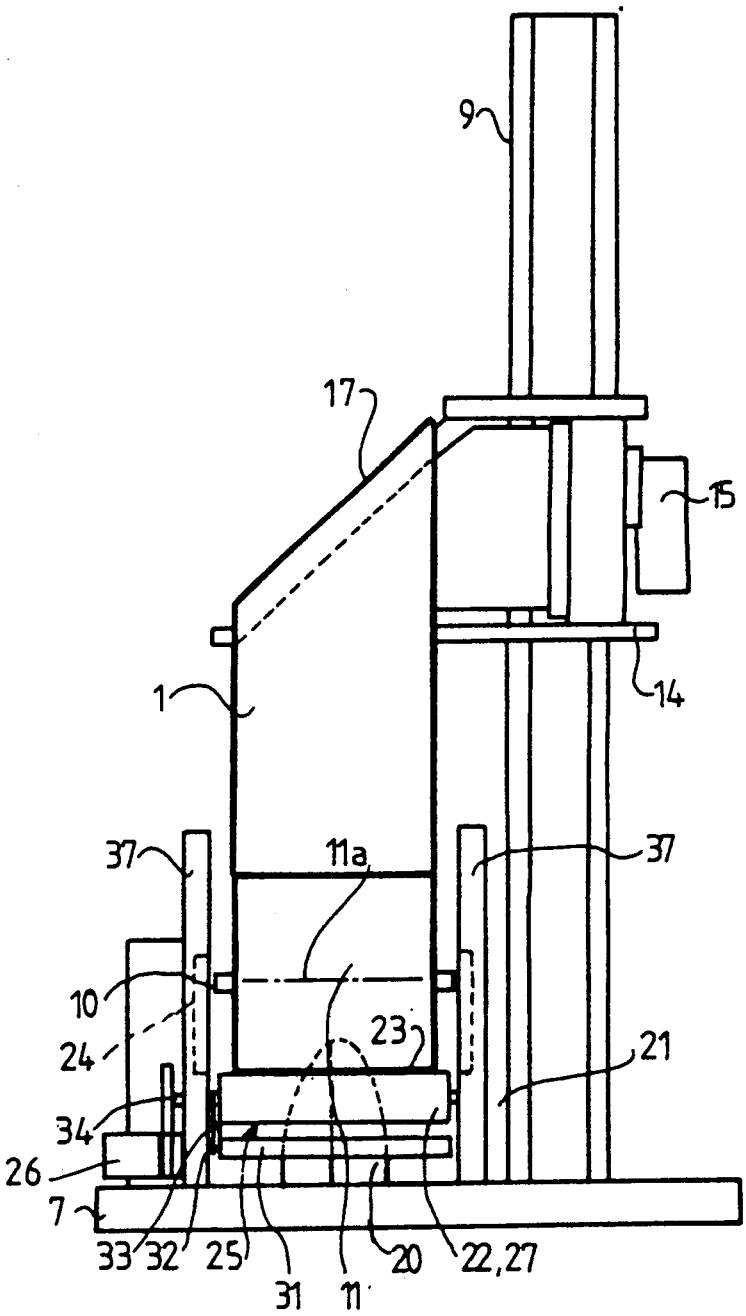
Figures 5A, 5B, 5C, 6:
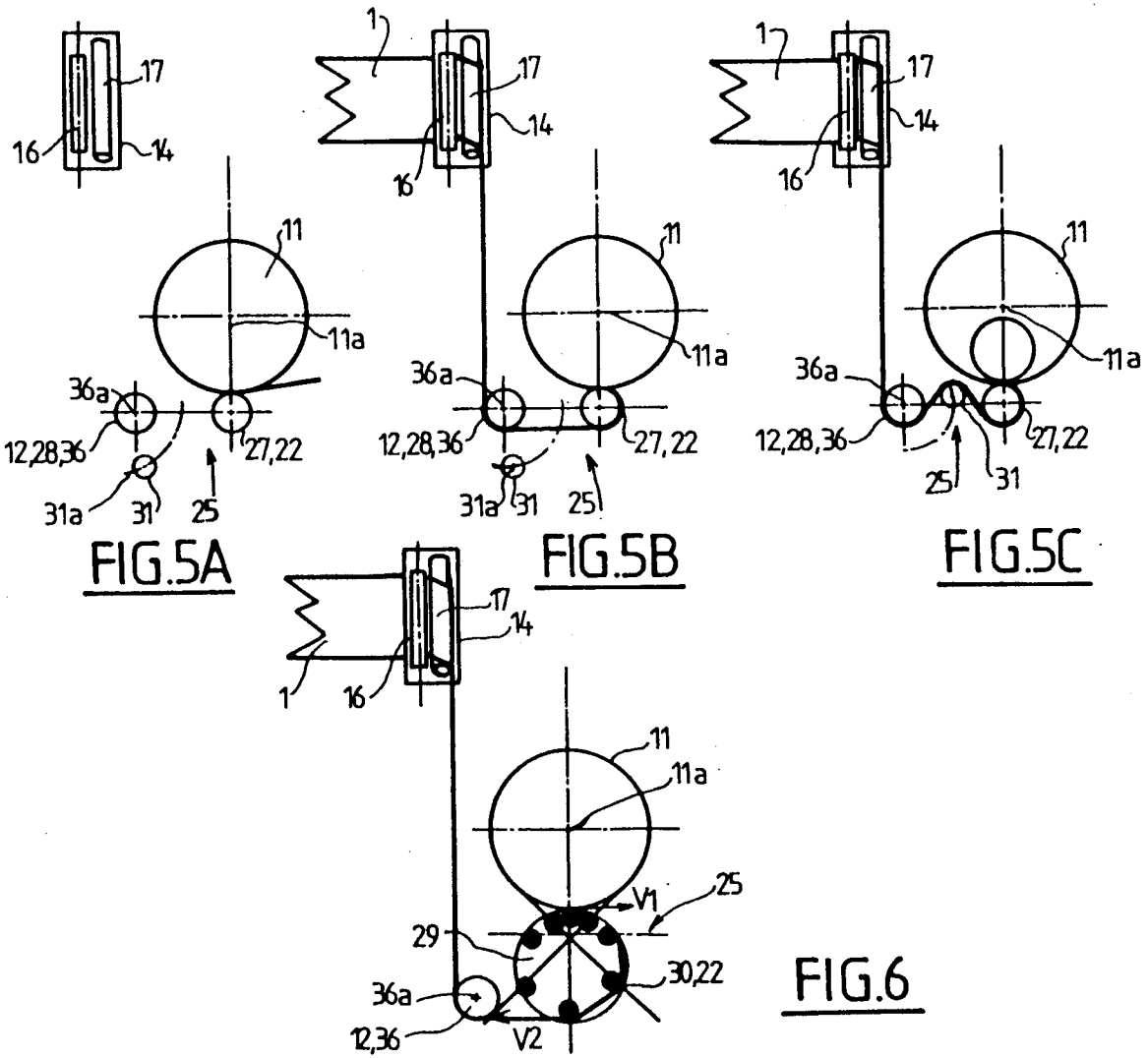
FIGS. 5A, 5B, 5C are three diagrammatic detailed views according to the view in elevation in FIG. 2 showing an alternative embodiment of the invention in three successive states.
FIG. 6 is a similar view of another alternative embodiment.
Figure 7:
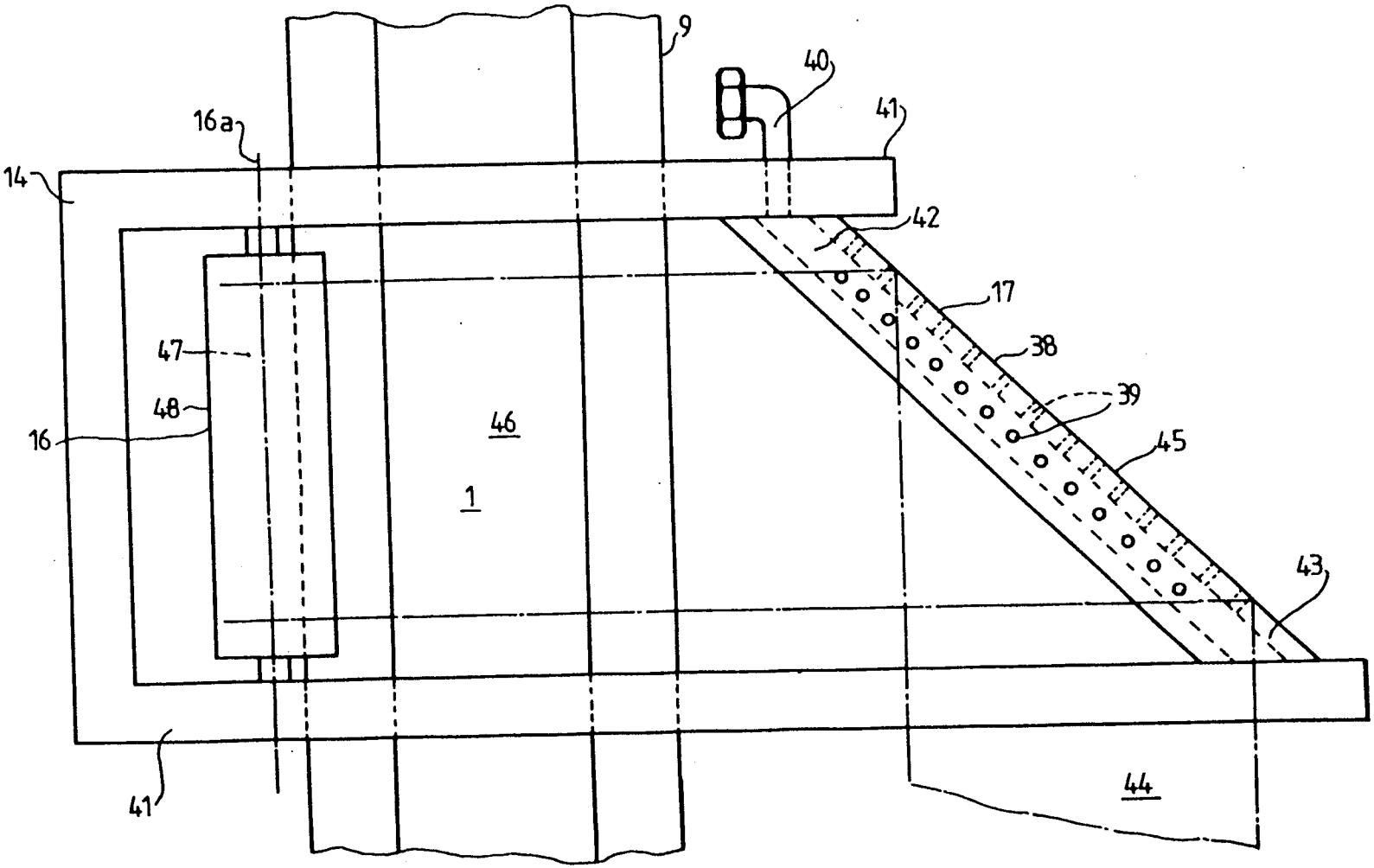
FIG. 7 is a diagrammatic view in elevation and on a larger scale of the carriage, the control roller and the device for changing the direction of the film.

In order to change the direction of the film 1 between the reel of film 1 and the load 3, and more particularly between the control roller 12 and the delivery roller 16, the film 1 is first driven so as to unwind vertically and then over a deviating roller forming part of the direction-changing means 17 and inclined relative to the horizontal, before reaching the delivery roller 16. In the case where the machine comprises a pre-stretching device 25 having generatrices arranged such that the film is displaced, from when it enters this device to when it leaves it, from an upstream unwinding speed V1 to a downstream unwinding speed V2 greater than V1, all the alternative embodiments of such pre-stretching devices are applicable. For example, the pre-stretching device 25 may be of the non-motorized type, it being driven by the movement of the film 1 itself; or of the motorized type, by way of a motor 26. The pre-stretching device 25 may be of the type having at least one upstream roller 27 and one downstream roller 28 arranged such that the circumferential speed of the downstream roller V2 is greater than that of the upstream roller V1 (FIGS. 1 to 5) or of the type having a single roller 29 whose generatrices 30 have a circumferential speed greater downstream V2 than upstream V1 (FIG. 6). The horizontal-axis pre-stretching device 25 is placed in a fixed location, near the bearings 10 and not in the vicinity of the delivery roller 16 as is generally the case in the prior art. The control roller 12 may form part of the pre-stretching device 25. The generatrix 13 is, for example, the downstream generatrix of the pre-stretching device 25. The support roller 22 may also form part of the pre-stretching device 25. For example, the support roller 22 defines the upstream generatrix of the pre-stretching device 25. Thus (FIGS. 2 to 4), with a pre-stretching device 25 having two rollers, an upstream one 27 and a downstream one 28, and motorized by way of a motor 26, the upstream roller 27 forms the support roller 22 and the downstream roller 28 forms the control roller 12.

Reference will now be made to FIGS. 5A to 5C which illustrate an alternative embodiment of a pre-stretching device 25 having two rollers 27 and 28. The machine also comprises, firstly, a roller 31 for positioning the film 1 in the pre-stretching device 25 and mounted so as to pivot freely on bearings 32 defining a horizontal axis 31*a*, said bearings 32 being mounted so as to be able to move between two extreme positions in which they may be locked, namely an engaging position where the positioning roller 31 is placed between the upstream 27 and downstream 28 pre-stretching rollers such that the film 1 is applied to the pre-stretching rollers 27, 28 and the positioning roller 31 which deviates it between the two of them, and a retracted position in which the positioning roller 31 is moved away from the upstream 27 and downstream 28 pre-stretching rollers and from the film 1, passing between them without deviating the film. The machine comprises, secondly, means 33 supporting and guiding the bearings 32 of the roller 31 between these two positions and, thirdly, means for maneuvering the bearings 32 enabling them to be displaced from one of their positions to the other. For example, the roller 31 is carried at the end of connecting rods 33 carried so as to be able to pivot at their other ends on elements adjoining the stand 7. A motor or jack 34 enables the connecting rods 33 to be maneuvered selectively.

The machine then functions as follows: when the reel of film 11 is to be changed, or alternatively in the event of the film 1 breaking, the reel of film 11 and the support roller 22 are driven such that the first end part 35 of the film 1 may be drawn backwards between the two of them (away from the table 6 and over a sufficient length). The positioning roller 31 is in its position retracted to a level below the two pre-stretching rollers 27, 28 (FIG. 5A). Maintaining the positioning roller 31 in this retracted position, the film 1 is positioned on the other rollers of the machine, namely 22 or 27, 12 or 28, 17, 16, pivoting the film 1 forwards by approximately 180° and then upwards (FIG. 5B). Lastly, the positioning roller 31 is moved from its retracted position to its engaging position (FIG. 5C) by the axis 31*a* of the roller 31 pivoting backwards and upwards by approximately a quarter of a revolution. Once the roller 31 is in this position, the film 1 is deviated until it has an inverted-V profile, which causes the film to be applied over a substantial part of the periphery of the pre-stretching rollers 27 and 28.

Reference will now be made to FIG. 6 in which a machine having a single pre-stretching roller 29, functioning as a support roller 22 for the reel 11, has been shown.

The machine may also comprise a front return roller 36, having a horizontal fixed axis 36*a*, placed substantially vertically, and beneath the carriage 14, and situated in the location of the bearings 10 downstream from the pre-stretching device 25 and/or from the support roller 22. In the case of the variant in FIGS. 1 to 5, the return roller 36 consists of the downstream roller 28 of the pre-stretching device 25 having two rollers, an upstream one 27 and a downstream one 28. In the case of the variant in FIG. 6, the return roller 36 consists of an additional roller to the single pre-stretching one 29.

The bearings 10, the pre-stretching device 25, the support roller 22, and the return roller 36 are carried by two fixed vertical cheeks 37. These two cheeks 37 are carried by the stand 7 and placed laterally next to the mast 9.

The carriage 14 essentially supports the delivery roller 16 and the associated means, as well as the means 17 for changing the direction of the film 1, with the exception of the bearings 10, of the reel of film 11 itself, of the pre-stretching device 25, of the support roller 22 and of the return roller 36.

The means 17 for changing the direction of the film comprise a bearing surface 38 carried rigidly by the carriage 14, inclined to the vertical and on which the unwinding film 1 slides without any substantial friction. The bearing surface 38 has perforations 39 with which are associated means 40 which generate or propel a compressed gas, which is discharged through the perforations 39, and which are capable of separating or tending to separate the film 1 from the bearing surface 38 with a view to reducing friction. The bearing surface 38 is placed substantially vertically, perpendicular to and above the return roller 36. The surface 38 is placed substantially next to, in the horizontal direction, the delivery roller 16. The axis 16*a* of the roller 16 is placed in or in immediate proximity to the vertical plane passing through the bearing surface 38. The bearing surface consists of a cylindrical section of a fixed bearing tube. The bearing surface 38 is inclined to the vertical by 45° or close to 45°.

The carriage 14 has at least one horizontal plate 41 extending transversely from the mast 9 to the cheek 37. The tube 38 is, for example, fixed between the two plates 41 which are spaced apart vertically and face one another. The means 40 have, for example, a connection piece for a supply of compressed air which is fixed to one of the plates 41 and communicates with a hole in the plate 41 communicating with the channel of the tube defining the bearing surface 38. The bearing surface 38 is inclined such that its upper end 42 is closest to the delivery roller 16, while the lower end 43 is, conversely, furthest away.

The film 1 coming from the return roller 36 arrives vertically, parallel to the plane R, at 44. The film then passes over the bearing surface 38 inclined by 45° with respect to the longitudinal direction of the advance of the film 1. After a half-revolution around the bearing surface 38 at 45, the film continues in the horizontal direction, parallel to the plane R at 46 towards the control roller 6. The film then arrives on the delivery roller 16 at 47 and then after a fraction of a rotation about the axis 16*a*, the film continues at 48 towards the load 3.

I claim:

1. A machine for helically wrapping a band of film about the vertical faces of a load, comprising:

a fixed stand;

a table on said stand for receiving the load to be wrapped;

means for rotating said table whereby said load is rotated about a vertical axis extending through said load;

a fixed vertical mast carried by the stand and forming a support;

bearing means rotatably supporting a reel of said film about a first horizontal axis for freely enabling said film to be unwound therefrom, said bearing means being carried by said stand;

a control roller rotatably mounted on said stand about a second horizontal axis to control the speed of flow of said film to said load being wrapped, said first and second horizontal axes being disposed parallel to each other;

a carriage mounted on the mast so as to slide up and down in the vertical direction between upper and lower extreme positions;

means to drive said carriage in a sliding motion being upper and lower extreme positions;

a delivery roller being rotatably carried by the carriage about a stationary vertical axis for passing said film to said load;

support means mounted on said carriage receiving said film directly from said control roller for continuously changing the direction of said film from a generally horizontal direction as the film leaves the control roller to a generally vertical direction as it enters the delivery roller;

a horizontal support roller for supporting the reel of film, said horizontal support roller placed in the same plane vertically beneath said bearing means to support the reel of film whereby the lower horizontal generatrix between the reel of film and the support roller forms a constant reference to control the speed of film being unwound from the reel and in cooperation with said control roller acting as a prestretching means for the film; and guide means receiving the bearing means whereby the bearing means slide freely in the vertical direction so that the reel of film rests on the horizontal support roller throughout the wrapping operation.

2. A machine as defined in claim 1 further including a pressure disk carried by the mast and mounted so as to be raised or lowered by drive means and freely rotatable about said vertical axis, said disk being driven in a rotatable motion by the load when the disk is pressed against an upper horizontal face of the load.

3. A machine as defined in claim 1 further including a pinching tool for gripping the film;

means for opening, closing and retracting said pinching tool;

means associated with the pinching tool for transversely cutting the film; and means for connecting the film to itself or to the load.

4. A machine as defined in claim 1 wherein both the bearing means supporting the reel of film and the control roller are located at a lower end part of the mast.

5. A machine as defined in claim 4 wherein the second horizontal axis through said control roller is disposed beneath the first horizontal axis through the bearing means.

6. A machine as defined in claim 1 wherein the control roller is situated near the bearing means.

7. A machine as defined in claim 1 further including means for pre-stretching the film such that the film enters the pre-stretching means at an upstream unwinding speed V1 and leaves the pre-stretching device at a downstream unwinding speed V2, said downstream speed V2 being greater than the upstream speed V1.

8. A machine as defined in claim 7 wherein said pre-stretching means comprises:

a pre-stretching device having an upstream and a downstream pre-stretching roller, and a positioning roller for positioning the film in the pre-stretching device, said positioning roller being freely rotatable about a horizontal axis, said positioning roller being movable between two extreme positions, an engaging position in which the positioning roller is placed between the upstream and downstream pre-stretching rollers such that the film is applied to the pre-stretching rollers while the positioning roller deviates the film between the upstream and downstream rollers, and a retractor position in which the positioning roller is moved away from the upstream and downstream pre-stretching rollers so that the film passes between them without deviating the film; and means displacing the positioning roller between the two positions.

9. A machine as defined in claim 8 wherein said upstream roller is said control roller.

10. A machine as defined in claim 9 wherein said downstream roller is said support roller.

11. A machine as defined in claim 1 where the support means for changing the direction of the film comprises a bearing surface on which unwinding film slides without any substantial friction therebetween, said bearing surface being inclined to the vertical by an angle close to 45°.

12. A machine as defined in claim 11 wherein a bearing surface has perforations through which a compressed air for separating the film from the bearing surface so as to reduce friction therebetween.

* * * * *